United States Patent [19]

Griffin et al.

[11] 4,183,881

[45] Jan. 15, 1980

[54] FLASH FIBRILLATION PROCESS

[75] Inventors: Brian P. Griffin; Alan W. Jukes, both of St. Albans; Cyril S. Wilkins, Welwyn Garden City, all of England

[73] Assignee: Imperial Chemical Industries Limited, London, England

[21] Appl. No.: 835,287

[22] Filed: Sep. 21, 1977

[30] Foreign Application Priority Data

Jul. 20, 1977 [GB] United Kingdom ..... 30456/77

[51] Int. Cl.[2] ..... D01F 7/00

[52] U.S. Cl. ..... 264/13; 264/40.3; 264/205; 425/6; 425/146; 425/149

[58] Field of Search ..... 264/40.3, 176 Z, 204, 264/205, 13, 40.7; 425/199, 200, 205, 209, 6, 146, 149

[56] References Cited

U.S. PATENT DOCUMENTS

| | | | |
|---|---|---|---|
| 3,227,794 | 1/1966 | Anderson et al. | 264/205 |
| 3,461,193 | 8/1969 | Gilardi | 264/176 Z |
| 3,478,389 | 11/1969 | Bradley et al. | 264/177 Z |
| 3,651,194 | 3/1972 | Bohrer | 264/205 |
| 3,879,519 | 4/1975 | Woodell | 264/205 |

*Primary Examiner*—Jay H. Woo

*Attorney, Agent, or Firm*—Cushman, Darby & Cushman

[57] ABSTRACT

The stability of a flash fibrillation process for converting thermoplastics materials into fibrils by flash extruding a hot pressurized dispersion of thermoplastics material in liquid through an orifice is improved by inserting a pressure-responsive valve in the orifice which ensures the dispersion is at a specified minimum pressure before it is extruded through the orifice. The minimum pressure should be sufficient to ensure the liquid does not volatilize prior to its extrusion through the outlet.

7 Claims, 4 Drawing Figures

FLASH FIBRILLATION PROCESS

This invention relates to an improved flash fibrillation process for converting thermoplastics materials into fibrils, especially fibrils suitable for use in papermaking processes.

Flash fibrillation processes for thermoplastics materials are described in U.S. Pat. Nos. 3,081,519 and 3,227,784 and in British Pat. Nos. 1,323,174, 1,336,915 and 1,446,034. Briefly, in a flash fibrillation process the thermoplastics material and a liquid are charged to a first zone maintained at a temperature sufficient to ensure that the thermoplastics material is fluid and that the liquid is above its normal (i.e. at atmospheric pressure) boiling point and maintained at a pressure sufficient to stop the liquid volatilising and then the charge is ejected through an outlet into a second zone at considerably lower pressure where the temperature is below the freezing point of the thermoplastics material and the temperature and pressure in the second zone are selected to promote rapid volatilisation of the liquid with the result that the forces accompanying the ejection and volatilisation shred and/or stretch the thermoplastics material into fibrils while heat lost from the thermoplastics material to the volatilising liquid accelerates the solidification of the thermoplastics material. The size of the outlet is often pre-set to optimise the fibrillating forces which occur as the charge is ejected.

Flash fibrillation processes (especially continuous processes) may suffer temporary periods of instability during which they produce random amounts of fibrils, foamed thermoplastics material or solid thermoplastics material accompanied by pockets of vapour.

This invention provides a flash fibrillation process (especially a continuous process) for converting thermoplastics materials into fibrils wherein a pressurised dispersion of thermoplastics material and liquid is ejected through an outlet governed by a pressure-responsive valve set to respond to the pressure of the dispersion upstream of the valve such that if the pressure falls below a predetermined level which is not below the level required to stop the liquid volatilising, the valve at least partially closes and if the pressure rises above the predetermined level the valve opens. The pressure-responsive valve improves the stability of the fibrillation process leading to the production of more uniform fibrils especially when the liquid comprises a mixture of water and organic liquid and/or when the process is operated continuously. Possibly, variations in the composition of the dispersion in the region of the outlet disturb the stability of the process and such variations are aggravated by the use of a continuous process where it is not practicable to improve the homogeneity of the dispersion by allowing it to stand for about an hour prior to ejection or by the use of a multi-phase liquid.

The invention also provides apparatus for making thermoplastics fibrils by the above flash fibrillation process comprising a pressure vessel having an outlet governed by a pressure-responsive valve set to respond to pressure variations upstream of the valve such that if the pressure falls below a predetermined value the valve at least partially closes and if the pressure rises above the predetermined level the valve opens.

Preferably the pressure-responsive valve is located within the outlet and comprises a closure biassed into closing engagement with the entrance portion of the outlet. Such a valve is opened when the pressure in the entrance portion is sufficient to force the closure back against the bias. Conveniently, the bias is adjustable so that the valve can be easily set to respond to a variety of predetermined levels of pressure. The closure may be, for example, a spring-loaded ball, cone or chamfered bar which seats into the entrance to the outlet. Balls and cones are preferred for outlets of circular cross-section and bars for outlets which are slits. Preferably, the diameter of the entrance and especially of the exit portions of the outlet is from 0.1 to 5.0 mm (most preferably from 0.5 to 3.0 mm) and the clearance between the entrance and especially the exit portions of a slit die is from 0.1 to 5.0 mm (most preferably from 0.15 to 0.5 mm).

The pressure vessel may be simply a reservoir fitted with a tap controlling the outlet so that a pressurised dispersion can be ejected from the reservoir merely by opening the tap. Preferably, the pressure vessel is provided with means for heating, pressurising and mixing the components of the dispersion. Especially in a continuous process, means may be provided for propelling the dispersion through the pressure vessel towards the outlet. In one embodiment of the invention, monomers may be polymerised in the liquid optionally when contained in the pressure vessel so as to provide a dispersion of polymeric thermoplastics material in the liquid in situ.

The pressure vessel may be a screw extruder. Thermoplastics material may be melted in the extruder and then a dispersion formed by injecting liquid into the molten thermoplastics material. Particularly efficient dispersion is obtained if the liquid is injected at a point where the thermoplastics material is at or just above (e.g. 10° C. above) its melting temperature. This technique is useful when the liquid is to comprise both water and an organic liquid because by injecting the water and organic liquid radially into the extruder barrel through separate inlets on a common circumference of the barrel it is easier to control whether the dispersion produced is an emulsion of water in organic liquid or vice versa. The dispersion is conveniently pressurised and propelled towards the outlet by the action of the screw and it can be conveniently heated by means conventionally provided on screw extruders.

The thermoplastics material may be dispersed in water, an organic liquid or a mixture of both. Preferbly, the organic liquid should have a dissolving or swelling effect on the thermoplastics material at least under the conditions used in the first zone. Examples include hydrocarbons such as pentane, hexane, heptane or decane or chlorinated and/or fluorinated hydrocarbons such as chlorofluoro ethanes. Optionally, the dispersion may contain nucleating agents which promote rapid volatilisation of the liquid. Nucleating agents should have critical temperatures well below the temperatures used in the first zone and should be sparingly soluble in the dispersion. Nitrogen and carbon dioxide are suitable. Other liquids and nucleating agents are disclosed in the patent specification quoted earlier in this description.

Depending on the miscibility of the thermoplastics material and the liquid and on the conditions of temperature and pressure used in the first zone, the dispersions used in flash fibrillation processes may be single or multi-phase mixtures. Multi-phase mixtures are preferred which comprise a dispersion of droplets of fluid polymer in liquid. If the liquid has a swelling effect on the thermoplastics material, the droplets will comprise a mixture of thermoplastics material and organic liquid. Most preferably, the liquid comprises a mixture of water and an organic liquid which is miscible with the thermoplastics material and the dispersion comprises at least three phases, namely water, organic liquid and fluid droplets of thermoplastics material mixed with organic liquid. Preferably, conditions are chosen to establish an emulsion of water and fluid polymer droplets in organic liquid. Accordingly, the dispersion preferably comprises a weight ratio of water to thermoplastics material of from 0.1 to 4.0 (especially 0.3 to 1.5):1 and a weight ratio of thermoplastics material to organic liquid of from 0.5 to 0.005 (especially 0.35 to 0.02):x where x is the density of the organic liquid relative to water.

However, it is also possible to use an emulsion of organic liquid and droplets of fluid polymer in water. In this case the dispersion preferably comprises from 1 to 20% (preferably 2 to 8%) by weight of organic liquid and 5 to 75% (preferably 35 to 60%) by weight of thermoplastics material, the percentages being based on the weight of water present. The use of large quantities of water increases the consumption of energy.

The predetermined level of pressure to which the pressure-responsive valve is set to respond is generally at least 0.1 $MN/m^2$ (preferably at least 0.5 $MN/m^2$) above the minimum pressure required to stop the liquid volatilising in the zone of the pressure vessel immediately upstream of the valves and usually called the first zone. For example, the valve may be set to respond to pressures of at least 2.0 and 3.3 $MN/m^2$ for pentane at 150° C. and 190° C. respectively or 1.3 and 2.0 $MN/m^2$ for hexane at 150° C. and 190° C. respectively. Conveniently, the pressure in the second zone (i.e. the zone downstream of the valve where the liquids volatilise) is atmospheric. Generally, the temperature of the first zone is at least 10° C. (preferably at least 25° C.) above the boiling point of the liquid at the pressure employed in the second zone.

The thermoplastics materials should have a molecular weight which would enable them to be converted into fibres. The preferred thermoplastics materials are crystalline especially crystalline aliphatic polyolefins such as low or high density polyethylene or blends of the two or copolymers of ethylene with up to 20% by weight of copolymerisable monomers, for example, vinyl acetate or methyl, ethyl or butyl esters of acrylic or methacrylic acids. The preferred polyolefin is a crystalline homopolymer of propylene or a copolymer of propylene with up to 20% by weight of ethylene preferably made by injecting ethylene into the latter stages of an otherwise propylene homopolymerisation process.

The polyolefin fibrils made according to this invention are especially suitable for use in paper-making processes where they may be used alone or blended with conventional paper pulps. For such purposes it is preferred that the polyolefins have melt flow indices of from 0.1 to 30.0 (especially 0.5 to 5.0)g/10 minutes as measured according to British Standard 2782:105: Part C of 1970 using a 2.16 Kg load at 230° C. in the case of polymers containing a major amount of propylene and at 190° C. in the case of ethylene polymers and copolymers.

In order to facilitate the use of the fibrils in paper-making processes, non-ionic, anionic or cationic surfactants may be added to the dispersion prior to flash fibrillation. Surfactants include polyvinyl alcohols and condensates of ethylene and propylene oxides. Other surfactants are disclosed in the patent specifications quoted earlier in this description.

The thermoplastics material may also contain the usual additives found in thermoplastics materials and paper such as stabilisers, pigments (especially titanium dioxide) and fillers (especially kaolin, chalk and talc).

The invention is further illustrated by the following descriptions which refer to the drawings in which.

Figure 1:
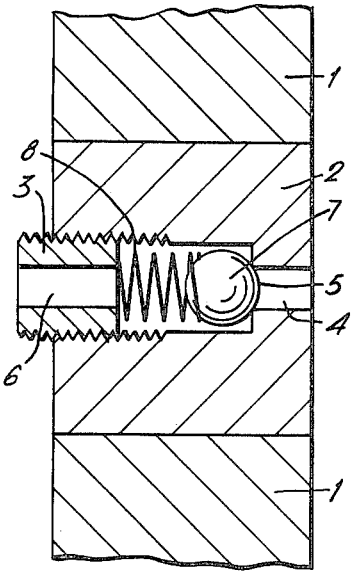
FIG. 1 shows in section an outlet located in a portion of a pressure vessel wall.

FIG. 1 shows part of wall 1 of a pressure vessel into which is screwed a threaded component 2. Component 2 together with externally threaded sleeve 3 defines an outlet from the pressure vessel, the outlet consisting of entrance orifice 4, expanded portion 5 threaded towards one end and exit orifice 6. Sleeve 3 screws into expanded portion 5. Expanded portion 5 also houses a pressure-responsive valve consisting of a closure in the form of a ball 7 which seats in entrance orifice 4 to close the outlet and a spring 8 which biasses ball 7 into closing engagement with entrance 4 and which reacts against sleeve 3. By screwing sleeve 3 into or out of expanded portion 5, the bias in spring 8 can be easily adjusted.

Figure 2:
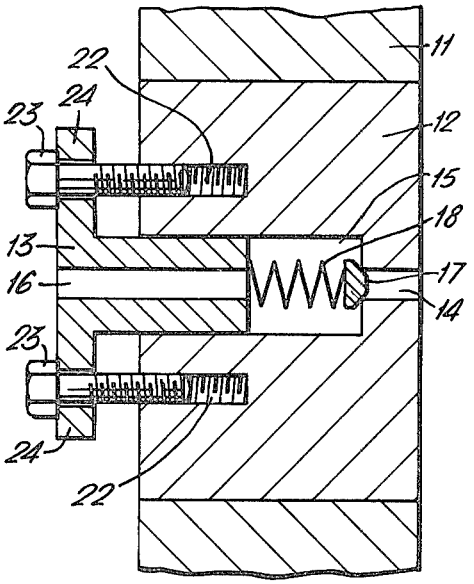
FIG. 2 shows in section an alternative outlet to that shown in FIG. 1.

FIG. 2 shows an alternative outlet comprising slit dies 14 and 16 instead of orifices 4 and 6. FIG. 2 shows a part of wall 11 of a pressure vessel into which a threaded component 12 is screwed. Component 12 together with sleeve 13 define an outlet consisting of entrance slit die 14, expanded portion 15 and exit slit die 16 which makes a press fit in expanded chamber 15 and is held in place by bolts 23 which pass through flanged ends 24 and engage in blind threaded bolt holes 22 formed in component 12. The positioning of bolts 23 along the length of slit die 16 is shown in FIG. 3.

Figure 3:
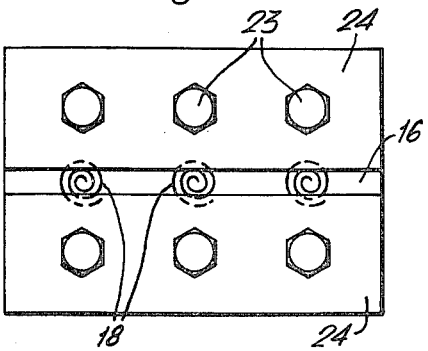
FIG. 3 shows in end elevation the sleeve, bolts and springs of the outlet shown in FIG. 2.
Figure 4:
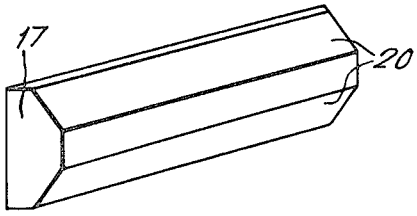
FIG. 4 shows in perspective on a larger scale the closure shown in FIG. 2.

Expanded portion 15 houses a pressure-responsive valve consisting of a closure in the form of a chamfered bar 17 and three springs 18 as shown in FIG. 3 which bias bar 17 into closing engagement with entrance slit die 14 and which react against sleeve 13. FIG. 4 shows the chamfered edges 20 of bar 17 which assist in seating bar 17 in slit die 14. The bias in springs 18 can be easily adjusted by turning bolts 23.

In operation the position of the exit defining sleeve relative to the expanded portion of the outlet is chosen so as to generate a pre-selected biassing force to hold the closure of the valve in closing engagement with the entrance portion of the outlet. A pressurised dispersion of thermoplastics material enters the entrance portion of the outlet and impinges upon the closure. As soon as the pressure of the mixture rises above the level required to overcome the bias on the closure, the closure is forced against the bias and the valve opens allowing the dispersion to be ejected through the outlet. If the biassing force has been chosen correctly, the dispersion is ejected under the correct conditions for stable fibrillation. If the biasing force has not been correctly chosen, it can be easily adjusted until the correct force is found.

The invention is further illustrated by the following Examples.

EXAMPLES 1 TO 7

Various thermoplastics materials as specified in Table 1 were charged to a screw extruder fitted with an outlet governed by a pressure-responsive valve as illustrated in FIG. 1. The dimensions of the exit orifice are specified in Table 1.

The thermoplastics material was conveyed to a point where it was melted. Pentane (hexane in Example 7) and water were injected radially into the extruder barrel at this point through separate inlets. The amounts injected are specified in Table 1. In Example 4, polyvinyl alcohol surfactant was added to the water prior to injection.

The contents of the extruder barrel were propelled to the outlet by the action of the screw and were heated to the temperatures specified in Table 1. The mixing action of the screw produced an emulsion of water and droplets of molten thermoplastics material in pentane. The droplets also contained absorbed pentane. The emulsion was pressurised by the action of the screw and the pressure-responsive valve was set to respond to the pressures specified in Table 1. When the pressure of the emulsion reached these pressures, the valve opened and emulsion was ejected through the outlet into a zone of ambient temperature and pressure whereupon flash fibrillation occurred. After a brief initial period of hunting, the flash fibrillation process became stable and produced highly uniform fibrils. The surface area of the fibrils obtained is specified in Table 1.

COMPARATIVE EXAMPLES A TO E

Examples 1 to 5 were repeated except that the outlet governed by the pressure-responsive valve was replaced by an outlet consisting of an uninterrupted orifice of the same diameter. In all cases it was found that fibrils were produced initially, but soon a large volume of vapour was ejected from the orifice. The cooling effect produced by the volatilisation of the large volume of liquid which had generated the vapour was sufficient to freeze the thermoplastics material in the outlet and form a plug which blocked the outlet. Pressure built up behind the plug until the plug was violently expelled from the outlet. Foamed polymer was then produced which then gave way to the production of fibrils again. However, the cycle repeated itself at irregular intervals.

The term "fluid" as applied to the droplets of thermoplastics material means that the droplets are in a liquid state because they are molten, dissolved in the organic liquid or swollen by the organic liquid. Preferably they are swollen.

TABLE 1

| Example | #TPM | †MFI | Orifice dimensions mm Length | Orifice dimensions mm Diameter | Weight ratio #TPM to pentane | Weight ratio water to #TPM | Weight ratio ††PVA to #TPM | Conditions adjacent entrance to outlet Pressure MN/m² | Conditions adjacent entrance to outlet Temp °C. | Surface area of fibrils m²/g |
|---|---|---|---|---|---|---|---|---|---|---|
| 1 | Ethylene copolymer containing 18% by weight of vinyl acetate. | 2.0 | 25 | 2.0 | 0.53 | 0 | 0 | 4.83 | 205 | — |
| 2 | Low density polyethylene. | 1.0 | 25 | 2.0 | 0.38 | 0 | 0 | 4.48 | 138 | 2.2 |
| 3 | High density polyethylene. | 14.0 | 25 | 2.0 | 0.053 | 0 | 0 | 2.07 | 135 | 10.7 |
| 4 | Copolymer of propylene containing 15% by weight of ethylene introduced during the latter stages of the polymerisation. | 1.5 | 27 | 2.0 | 0.06 | 0.53 | 0 | 10.3 | 171 | 1.5 |
| 5 | As in 4. | 1.5 | 2 | 0.5 | 0.06 | 0.53 | 0 | 10.3 | 171 | 1.5 |
| 6 | Polypropylene. | 4.5 | 25 | 2.0 | 0.06 | 1.25 | 0.0125 | 1.72 | 120 | 1.7 |
| 7 | Polypropylene. | 4.5 | 0.5 | 0.5 | *0.04 | 0.77 | 0.0077 | 1.72 | 200 | — |

Notes to Table
#Thermoplastics material
† Melt Flow Index in g/10 minutes.
†† Polyvinyl alcohol
*Hexane used instead of pentane.

We claim:

1. A flash fibrillation process for converting thermoplastics materials into fibrils wherein a pressurised dispersion of thermoplastics material and liquid is ejected through an outlet within which is located a pressure-responsive valve set to respond to the pressure of the dispersion in the entrance portion of the valve such that if the pressure falls below a predetermined level which is not below the level required to stop the liquid volatilising, the valve at least partially closes and if the pressure rises above the predetermined level the valve opens.

2. A process according to claim 1 operated continuously.

3. A process according to claim 2 wherein the liquid comprises water and an organic liquid and wherein both the water and the organic liquid are introduced into the pressure vessel at points which are the same distance from the outlet.

4. A process according to claim 3 wherein the organic liquid is a hydrocarbon containing from 5 to 10 carbon atoms.

5. A process according to claim 1 wherein the pressurised dispersion comprises droplets of fluid polymer in liquid.

6. A process according to claim 5 wherein the pressurised dispersion is an emulsion of water and polymer droplets in organic liquid.

7. A process according to claim 1 in which the pressure-responsive valve is set to respond to a pressure of from 0.1 to 3.3 MN/m² above the pressure immediately upstream of the valve.

* * * * *